United States Patent [19]

Nishiyama

[11] Patent Number: 4,614,421

[45] Date of Patent: Sep. 30, 1986

[54] DUPLICATING-SHEET-NUMBER SETTING DEVICE

[75] Inventor: Haruo Nishiyama, Nara, Japan

[73] Assignee: Sharp Kabushiki Kaisha, Osaka, Japan

[21] Appl. No.: 743,745

[22] Filed: Jun. 12, 1985

[30] Foreign Application Priority Data

Jun. 13, 1984 [JP] Japan ..... 59-122780
Jul. 23, 1984 [JP] Japan ..... 59-153579

[51] Int. Cl.[4] ..... G03G 15/00

[52] U.S. Cl. ..... 355/14 CU; 355/3 R; 355/14 C; 355/14 R; 377/8

[58] Field of Search ..... 355/14 CU, 14 R, 3 R; 235/59 R, 91 C, 91 R, 132 R, 145 R; 364/200, 518; 377/8

[56] References Cited

U.S. PATENT DOCUMENTS 3,989,930 11/1976 Sohm ..... 355/14 CU X
4,286,865 9/1981 Satomi et al. ..... 355/14 CU
4,383,756 5/1983 Hanamoto et al. ..... 355/14 CU
4,417,350 11/1983 Ito et al. ..... 355/14 CU X
4,491,827 1/1985 Sugiura et al. ..... 355/14 CU X
4,501,485 2/1985 Tsudaka ..... 355/14 CU X
4,506,974 3/1985 Sugiura et al. ..... 355/14 CU X

*Primary Examiner*—A. C. Prescott
*Attorney, Agent, or Firm*—Birch, Stewart, Kolasch & Birch

[57] ABSTRACT

A duplicating-sheet-number setting device for the duplicating apparatus operating unit is composed of a copy button for starting the duplicating operation, a counter which counts up when the copy button has been operated and counts up the operating frequency when the copy button has been operated while the duplicating operations is being effected, a display which displays the digital value of the counter as a set number of the duplicating sheets so that the number provided by depression of the copy button may become the number of the duplicating sheets, thereby to render to enable the copy button in function to start the duplicating operation and simultaneously to set the number of the duplicating sheets.

2 Claims, 5 Drawing Figures

P1 F/F : flip-flop for count up use

P2 F/F : flip flop for count down use

DUPLICATING-SHEET-NUMBER SETTING DEVICE

BACKGROUND OF THE INVENTION

The present invention relates to a device for setting the number of the duplicating sheets for a duplicating apparatus which is capable of continuously duplicating a plurality of duplicating sheets of a set number, and more particularly, to a device for setting the number of duplicating sheets, which uses a copy button to start the duplicating operation.

A duplicating apparatus which was adapted in function to continuously duplicate the number of a plurality of duplicating sheets was provided in its operating unit with ten-keys, a display, which displays the numerical values inputted by the ten-keys, as a device for setting the number of the duplicating sheets. The number of the duplicating sheets was applied upon the ten-keys by these means and thereafter the copy button was operated to cause the duplicating operation to be effected. However, the ten-keys required a large space for the arrangement of keys corresponding to the respective numeral from 0 to 9, and the operation was so complicated that the error operations were inconveniently caused. Also, a much larger space was required to increase identification by respective larger keys or wider spaces for prevention of the error operations, thus resulting in an inconveniently large-sized operating unit. Thus, some operating units as devices for setting the number of the duplicating sheets are provided with two types of keys, count-up and count-down, instead of the ten-keys, so that the set number of the duplicating sheets is decreased or increased in number by the count-up key and the count-down key. The numerical values of the set number which has been increased or decreased in accordance with the frequency of the depressed keys or the depressed time of the keys are adapted to be delayed on a display. However, the conventional device for setting the number of the duplicating sheets required a unit for causing the duplicating operation to be started after the number of the duplicating sheets has been set and its operation. Therefore, the satisfactory results were not provided in simpler operation and smaller operating units.

SUMMARY OF THE INVENTION

Accordingly, the present invention has been developed with a view to substantially eliminating the above discussed drawbacks inherent in the prior art duplicating-sheet-number setting device for a duplicating apparatus operating unit and has for its essential object to provide an improved setting device taking advantage of the merits of the prior art setting devices.

Another object of the present invention is to provide an improved duplicating-sheet-number setting device therefor which provides a copy button, which causes the duplication operation to be started, with a function of increasing the set number at the setting of the number of the duplicating sheets so as to remove the ten-keys from the operating unit for a duplicating apparatus and to simplify the operation of the duplicating apparatus.

A further object of the present invention is to provide an improved duplicating-sheet-number setting device, which is rendered smaller in size in the operating unit for the duplicating apparatus to reduce the number of the components so as to make it possible to provide lower cost.

In order to accomplish these objects of the present invention, an improved duplicating-sheet-number setting device for the duplicating apparatus operating unit is composed of a copy button for starting the duplicating operation, a counter which counts up when the copy button has been operated and counts up the operating frequency when the copy button has been operated while the duplicating operations is being effected, a display which displays the digital value of the counter as a set number of the duplicating sheets so that the number provided by depression of the copy button may become the number of the duplicating sheets.

According to the present invention, such construction as described hereinabove enables the copy button in function to start the duplicating operation and simultaneously to set the number of duplicating sheets. Therefore, it is not required to arrange ten-keys, which sets the number of the duplicting sheets, on the duplicating apparatus operating unit. Error operations at the setting operation of the number of the duplicating sheets may be prevented. In addition, the operating unit of the duplicating apparatus may be made smaller in size and the number of the operating components may be reduced. Thus, the production cost of the duplicating apparatus may be reduced.

Also, in the operating unit of the duplicating apparatus, a timer is provided which counts the depression time when the copy button has been depressed, a counter is provided which counts up or counts down when the depression time of the copy button is more than a given time, and which counts down or counts up when the depression time is within a given time, the digital value of this counter is displayed on the display, which is provided on the operating unit, as a set number of the duplicating.

As described hereinabove, the present invention has advantages in that the operationality of the duplicating apparatus is improved and the cost may be reduced. The copy button, which causes the duplicating operation to be started, is provided with a function of setting the number of the duplicating sheets and the keys which are used only in the setting operation of the number of the duplicating sheets may be omitted from the duplicating apparatus operating unit. Therefore, a duplicating operation including the setting operation of the duplicating sheets may be simplified, the duplicating apparatus operating unit may be made smaller in size, and the components may be reduced in number.

BRIEF DESCRIPTION OF THE DRAWINGS

These and other object and features of the present invention will become apparent from the following description taken in conjunction with the preferred embodiments thereof with reference to the accompanying drawings, in which.

DETAILED DESCRIPTION OF THE INVENTION

Figure 1:
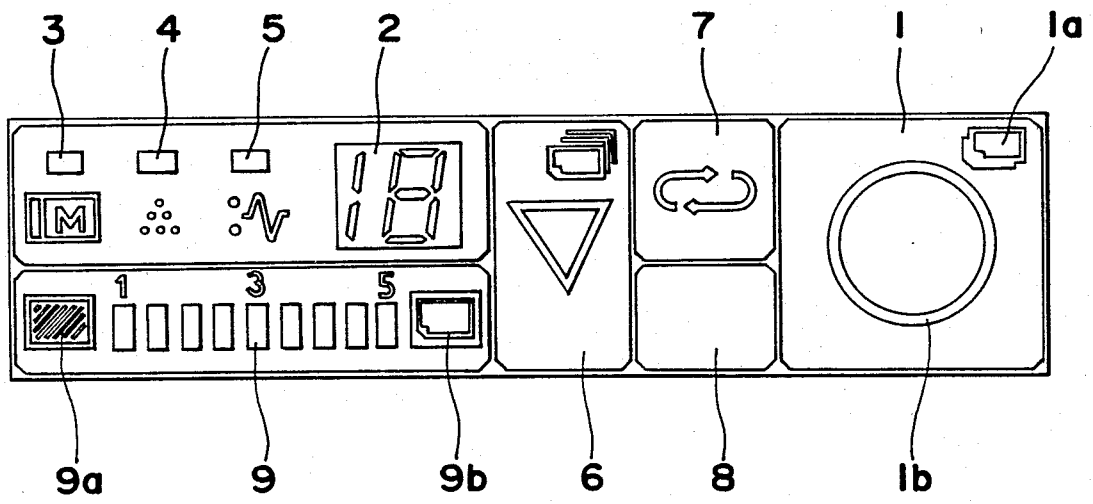
FIG. 1 is a plan sketch drawing of the operating unit of a duplicating apparatus in the embodiment of the present invention.

Before the description of the present invention proceeds, it is to be noted that like parts are designated by like reference numerals throughout the accompanying drawings.

Referring now to the drawings, there is shown in FIG. 1 an operating unit of a duplicating apparatus using a device for setting the number of the duplication sheets according to one preferred embodiment of the present invention. Three types of warning display lamps, a master exchange lamp 3, a toner supply lamp 4 and a paper choking lamp 5 are disposed on the schematic drawings representing the respective functions on the upper left portion of the operating unit. A duplicating sheet number display 2, which digitally displays the set number of the duplication sheets by luminous diodes, is disposed on the right-hand side of the warning display lamps. The largest number of the duplication sheets to be set as 19 in this embodiment. Exposure adjusting switches 9*a* and 9*b* for adjusting the exposure of condition of the duplication, an exposure display 9 which displays adjusting switches are disposed on the lower left portion of the operating unit. A count-down key 6 which reduces the set number of the duplicating sheets, a repetition key 7 which repeats the duplicating operation, an erasing key 8 to be used in erasing the numerical value displayed on the duplication-number display 2 which has been set, a copy button 1 which causes the duplication operation to start to set the number of the duplication sheets are disposed on the right portion of the operating unit. The surface of this copy button 1 is made of light admitting plastic, the portions except for a portion 1*b* surrounded by two illustrated concentric circles and a schematic drawing 1*a* are shielded in light. In addition, two coloring lamps not shown are disposed under this copy button 1, the red color before the warming-up operation is completed after the current has been flowed to the duplicating apparatus main body, the green color in a ready condition for copying operation after the warming-up operation has been completed are distributed in light from the light admitting portions 1*a* and 1*b* to show whether or not the duplication may be effected. A copy button is once operated after the portions 1*a* and 1*b* of the copy button 1 have been radiated in green to show the ready condition, a numeral 1 is displayed on the duplication-sheet-number display 2 and simultaneously the duplication operation starts. When the duplication is required to be performed by plurality, the copy button 1 is operated by a desired number of sheets. In this case, a numeral 1 is displayed on the duplication-sheet-number display 2 at a time of a first computer button operation, the duplicating operation starts, the number provided through the operation by the copy button 1 continuously after that is added to the numeral 1 displayed to display it on the duplication-sheet-number display 2. To perform ten sheet duplications, operate the copy button 1 once in the ready condition, operate the copy button 1 nine times after the duplicating operation has started, and a numeral 10 is displayed on the duplication-sheet-number display 2. The displayed numeral 10 is reduced in number each time the duplicating operation has been completed. Operate the erasing key 8 and the numeral value displayed may be rendered 0.

Figure 2A:
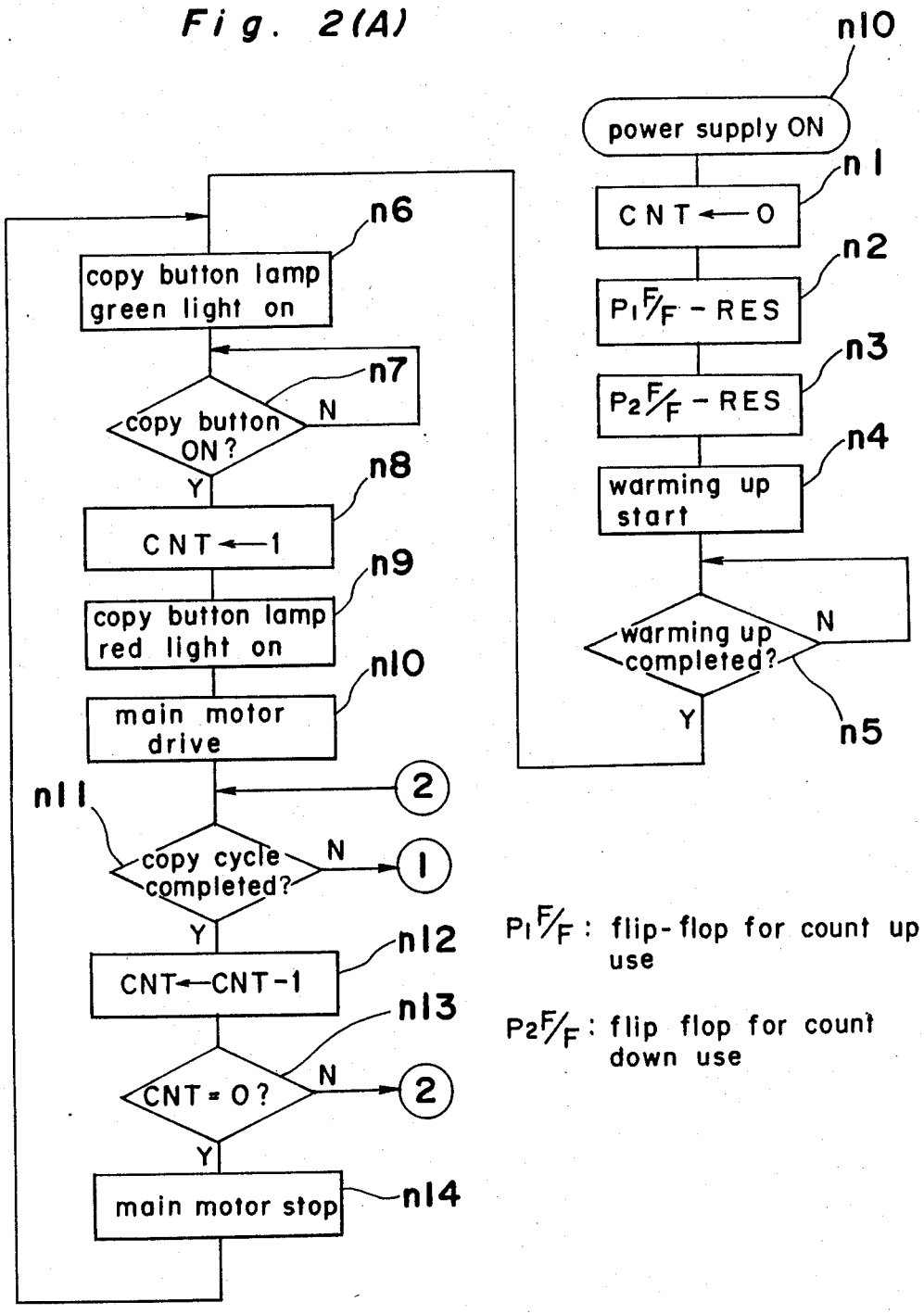
FIGS. 2(A) through 2(C) are flow charts showing the operation of the duplicating apparatus provided with a duplicating-sheet-number setting device, which is an embodiment of the present invention.
Figure 2B:
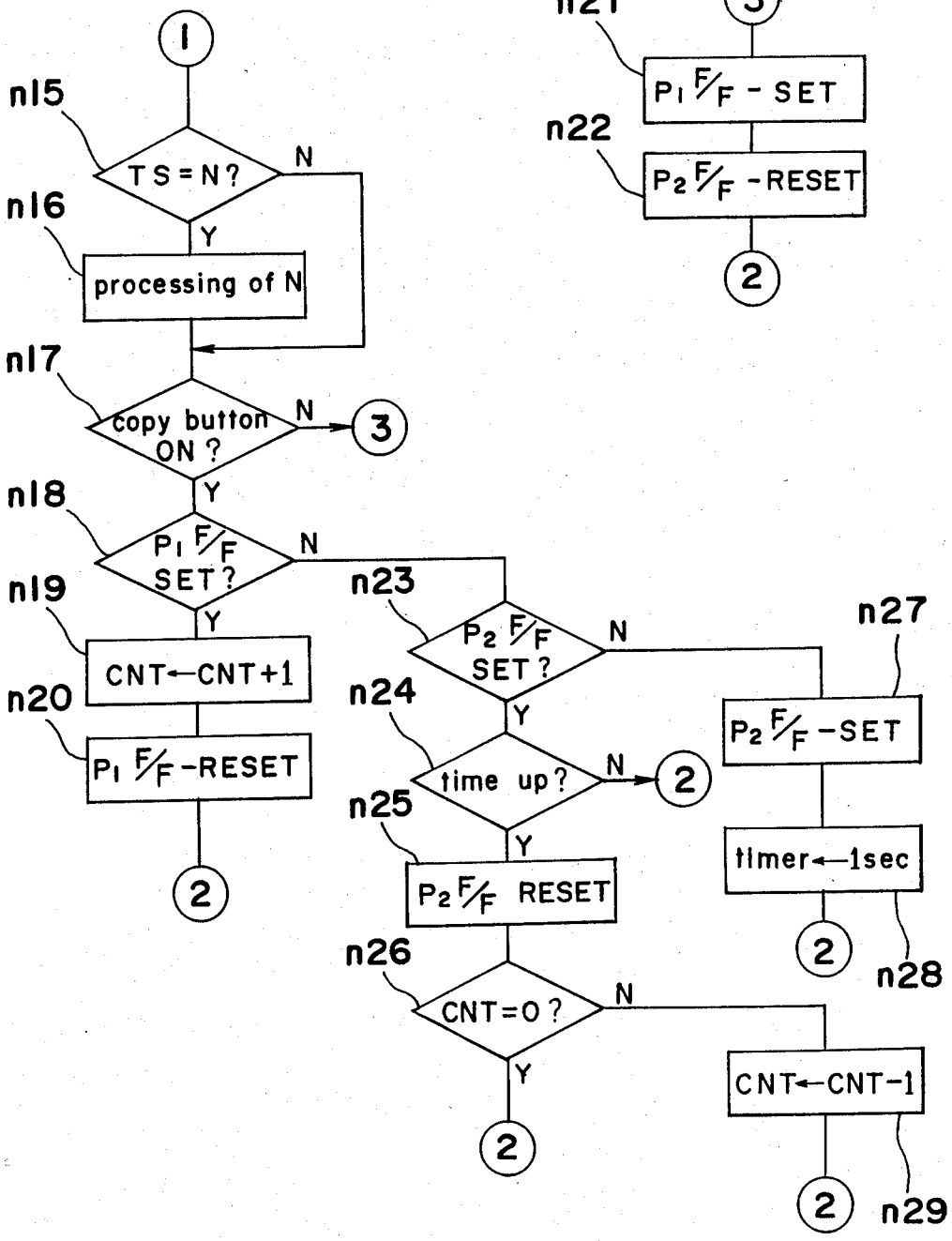
Figure 2C:
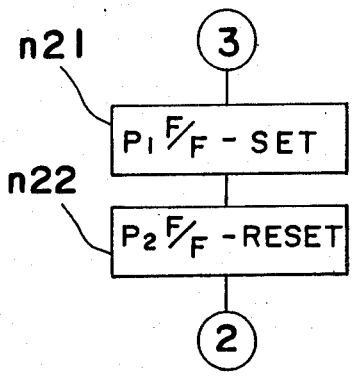

FIGS. 2(A) through (C) are flow charts showing the operation of a duplicating apparatus provided with a device for setting the number of the duplication sheets, which is an embodiment of the present invention.

Turn on a main switch of a duplicating apparatus main body n0 and the digital value of the counter is changed into 0 at a step n1 (hereinafter, step n1 is referred to simply as n1), a flip-flop P1 for count-up use and a flip-flop P2 for count-down use are reset respectively at steps n2 and n3. Thereafter, a warming-up operation which raises the temperature of the heat roller for fixing use to a given temperature is stared at step n4, the warming-up operation is completed at step n5, and the green lamp of the copy button is lit at step n6 to display the ready condition. When a copy button 2 is depressed as n7, the digital value of the counter is turned into 1 at n8 to display the numeral 1 on the device for setting the number of the duplication sheets. Thereafter, the red lamp of the copy button 2 is lit at n9, and a main motor is driven at step n10 to complete the copy cycle. At step n12, the digital value of the counter is counted down by one. When the digital value of the counter becomes 0, the main motor is brought to a stop at step n14. The step returns to step n6 to wait for the depression of the copy button.

When the copy cycle is not completed at step n11, the step advances to n15 to detect, by the reading operation of a timing signal (hereinafter referred to as TS), which step the copy operation is carrying out. When TS has been read out, the number N is carried out at step n16. It is to be noted that TS is read through detection of the slit of the slit disk. Then, at step n17, whether or not the copy button is depressed is decided. When the copy button is not depressed, the step advances to n21 where the flip-flop P1 is set. The flip-flop P2 is reset at step n22 and the step returns to step n11. The flip-flop P1 is set to step n21 to allow the count-up function to be performed in the depressing of the copy button during the copy cycle.

When the copy button is in its depressed position at step n17, the step advances to step n18 to decide whether or not the flip-flop P1 of the count up is kept set. When the flip-flop is kept set, the digital value is counted up by one at step n19 to keep the flip-flop P1 reset at step n20 and the step returns to n11. The digital value of the counter is counted up when the copy button is once depressed during the copy cycle by the above-described operation.

When the flip-flop P1 is kept reset at step n18, the step advances to step n23 to decide there whether or not the flip-flop P2 for count-down use is kept set. When the flip-flop P2 is reset at step n23, the step advances to step n27, where the flip-flop P2 is kept set. The, one second is set a timer n28 and the step returns to step n11. When the flip-flop P2 is kept set at step n23, at step n24 the decision is made as to whether or not the time is made up. When the time is made up, the flip-flop P2 is reset at step n25. When the digital value of the counter is not 0 at step n26, the digital value of the counter is counted down at step n29 and the step returns to step n11. When the timer is not made up in time at step n24 or when the digital value of the counter is 0 at step n26, the step returns directly to step n11. The digital value of the counter is counted up when the copy button is once depressed during the copy cycle by the above-described operation. Thereafter, when the copy button is continuously depressed, the digital value of the counter is counted down by one every time one second passes, because n24→n25→n26→n29 is repeated.

It is noted that the digital value of the counter may be counted up when the copy button is kept depressed for a given time period or more, the digital value thereof may be counted down when the copy button is kept depressed within a given time period. Also, when the respective flip-flops have been set, either the count-up or count-down, which is being carried, is displayed on the operative unit so that the user may visually confirm it. In addition, the setting operation of the number of the duplicating sheets may be effected even during the execution of the warm-up to shorten the duplication operating time period.

Figure 3:
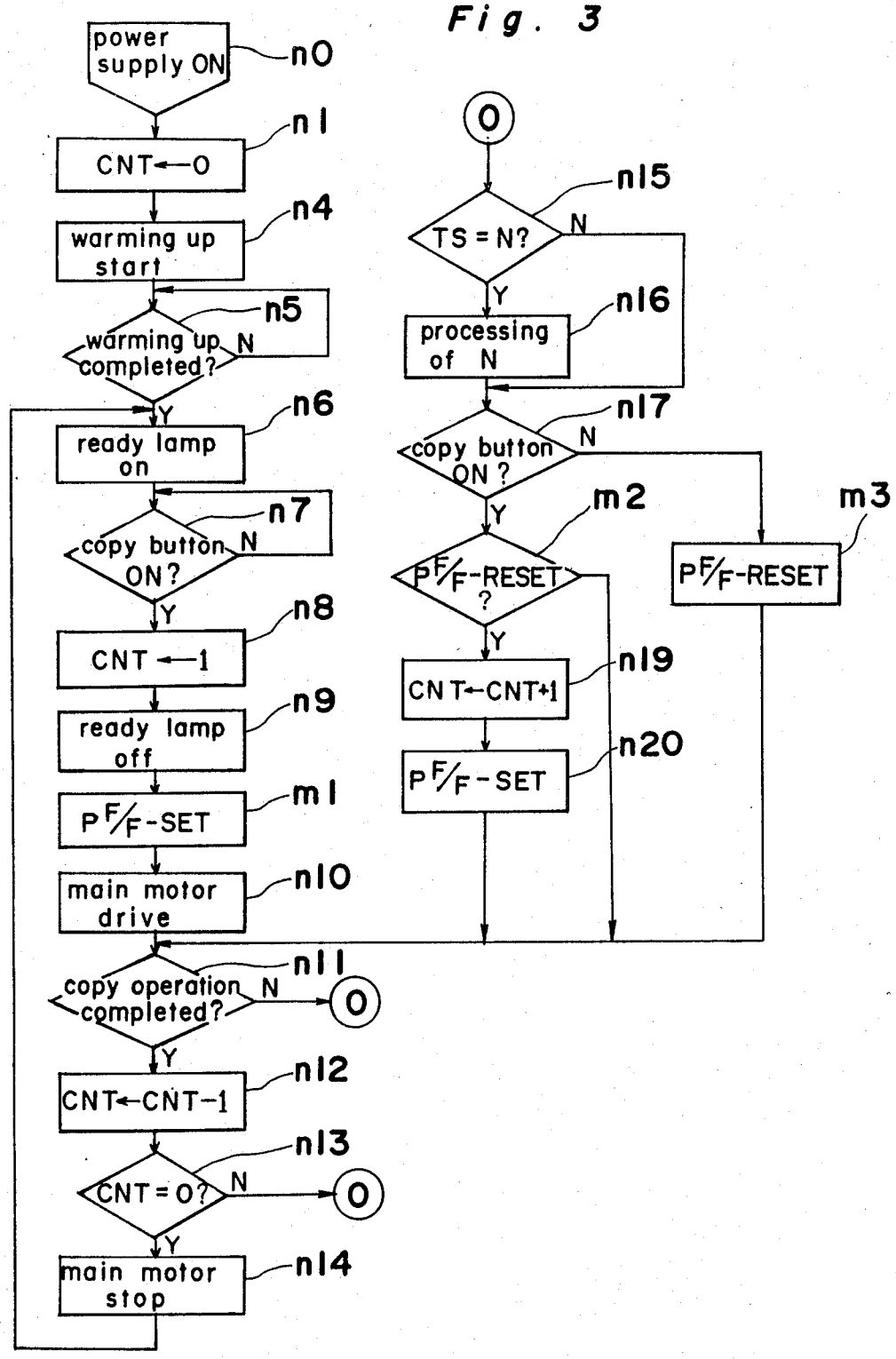
FIG. 3 is the other embodiment showing the operation of the duplicating-sheet-number setting device of the present invention.

FIG. 3 is the other modified example of a flow chart showing the operation of the device for setting the number of the duplicating sheets in accordance with the present invention. Steps n1 through n20 are the same as those of FIG. 2. The different points in the flow chart between FIG. 3 and FIG. 2 are that the ready lamp is turned off at step n9, thereafter the flip-flop is set at step m1, a main motor of the duplicating apparatus is driven at step n10 to start the duplicating operation. Also, at step n17, a decision is made as to whether or not the copy button has been operated. When it has been operated, a decision is made at step m2 as to whether or not the flip-flop is kept reset. When the flip-flop is kept reset, the digital value of the counter is counted up at step n19, step n20 advances to step n11. When the copy button is not operated at step n17, the flip-flop is reset at step m3 and the step advances to step n11. When the flip-flop is kept set at step m2, the step advances from here to step n11. Each time the copy button is operated once during the duplicating operation by the above operations, the flip-flop is repeatedly set and reset. Accordingly the number of the copy button operations may be counted by the use of the repetition of the setting and resetting of the flip-flop In the above embodiment, the number of the duplicating sheets may be set only when the duplicating apparatus is kept operating, and the number thereof may be set in the duplicating apparatus during the warming-up operation after excitation of the duplicating apparatus. Also, the counting up operation may be effected by the continuous depression of the copy button although the number of the operations by the copy button is adapted to be counted in the counter.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A duplicating-sheet-number setting device for an operating unit of a duplicating apparatus, which is provided with a display for displaying the set number of the duplicating sheets, a copy button which causes the duplicating operation to be started, and is capable of continously duplicating the set number of duplicating sheets from one sheet of document, characterized in that a counter is provided which is counted up when said copy button has been operated and counts up the number of operations when the copy button has been operated during the duplicating operation, the digital value of the counter is displayed, on said display, as the set number of the duplicating sheets.

2. A duplicating-sheet-number setting device for a duplicating apparatus which is provided in its operating unit with a display for displaying the set number of the duplicating sheets, a copy button which causes the duplicating operation to be started, and is capable of continuously duplicating the set number of duplicating sheets from one sheet of document, characterized in that a timer is provided which counts the depression time when said copy button has been depressed, a counter is provided which counts up or counts down when the depression time of said copy button is more than a given time, and which counts down or counts up when the depression time is within a given time, the digital value of this counter is displayed on said display as a set number of the duplicating sheets.

* * * * *